US009151099B2

(12) United States Patent
Allison

(10) Patent No.: US 9,151,099 B2
(45) Date of Patent: Oct. 6, 2015

(54) EGRESS DOOR OPENING ASSISTER

(71) Applicant: SAVANNAH RIVER NUCLEAR SOLUTIONS, LLC, Aiken, SC (US)

(72) Inventor: Thomas L Allison, Martinez, GA (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 0 days.

(21) Appl. No.: 13/666,144

(22) Filed: Nov. 1, 2012

(65) Prior Publication Data

US 2013/0111815 A1 May 9, 2013

Related U.S. Application Data

(60) Provisional application No. 61/628,656, filed on Nov. 3, 2011.

(51) Int. Cl.

| | |
|---|---|
| ***E05F 11/00*** | (2006.01) |
| ***E05F 1/10*** | (2006.01) |
| *E05F 5/08* | (2006.01) |

(52) U.S. Cl.

CPC . *E05F 1/105* (2013.01); *E05F 5/08* (2013.01); *E05Y 2201/426* (2013.01)

(58) Field of Classification Search

USPC ..... 49/379, 276, 324, 356; 292/207, 292/DIG. 19, 198

See application file for complete search history.

(56) References Cited

U.S. PATENT DOCUMENTS

| | | | | |
|---|---|---|---|---|
| 184,166 | A | 11/1876 | Meyers | |
| 1,683,426 | A * | 9/1928 | Thrasher | 292/198 |
| 2,190,653 | A | 12/1935 | Dunn | |
| 3,818,637 | A | 6/1974 | Vivier | |
| 4,019,220 | A | 4/1977 | Lieberman | |
| 4,040,144 | A * | 8/1977 | Lasier et al. | 16/66 |
| 4,339,843 | A | 7/1982 | Burnett, Jr. | |
| 4,419,786 | A | 12/1983 | Surko, Jr. | |
| 4,709,949 | A | 12/1987 | Umezawa et al. | |
| 4,729,490 | A | 3/1988 | Ziegenbein | |
| 5,220,747 | A | 6/1993 | Cherry et al. | |
| 5,274,881 | A * | 1/1994 | DeRosa | 16/230 |
| 5,369,911 | A * | 12/1994 | Fortunato | 49/25 |
| 5,579,606 | A | 12/1996 | Kim | |
| 5,758,913 | A * | 6/1998 | Roth et al. | 292/251.5 |
| 6,338,536 | B1 * | 1/2002 | Ueno et al. | 312/405 |
| 6,609,738 | B1 * | 8/2003 | Roth et al. | 292/251.5 |
| 6,711,856 | B1 * | 3/2004 | Hoffman | 49/386 |
| 7,770,959 | B2 * | 8/2010 | Browne et al. | 296/146.12 |
| 7,793,600 | B2 | 9/2010 | Dunstan | |
| 7,971,393 | B2 * | 7/2011 | Gao et al. | 49/386 |
| 8,108,971 | B2 * | 2/2012 | Florek | 16/357 |
| 8,196,259 | B2 * | 6/2012 | Armstrong et al. | 16/66 |
| 2009/0113804 | A1 * | 5/2009 | Manny et al. | 49/379 |
| 2009/0229186 | A1 * | 9/2009 | Park | 49/276 |

OTHER PUBLICATIONS http://products.construction.com/manufacter/rixson-door-controls-nst56624; Rixson Assa Abloy 2900 Low Energy Automatic Door Opener; Dec. 14, 2011; 3 pages.

* cited by examiner

*Primary Examiner* — Katherine Mitchell
*Assistant Examiner* — Shiref Mekhaeil
(74) *Attorney, Agent, or Firm* — J. Bennett Mullinax, LLC

(57) ABSTRACT

A door opening spring assistance apparatus is set forth that will automatically apply a door opening assistance force using a combination of rods and coil springs. The release of the rods by the coil springs reduces the force required to set the door in motion.

11 Claims, 2 Drawing Sheets

EGRESS DOOR OPENING ASSISTER

RELATED APPLICATIONS

This application claims the benefit of U.S. Provisional Application 61/628,656 filed on Nov. 3, 2011 and which is incorporated herein by reference.

STATEMENT AS TO RIGHTS TO INVENTIONS MADE UNDER FEDERALLY SPONSORED RESEARCH AND DEVELOPMENT

This invention was made with Government support under Contract No. DE-AC09-08SR22470 awarded by the United States Department of Energy. The Government has certain rights in the invention.

FIELD OF THE INVENTION

This invention is directed towards a spring assisted door opening device that will reduce the amount of force a manual operator must apply to open the door.

BACKGROUND OF THE INVENTION

In many commercial buildings and manufacturing facilities, heavy metal doors are often utilized for purposes of security, fire doors, or serve as containment doors between an enclosure having a negative air pressure relative to an environment on an opposing side of the door. Frequently, the requirements and operating environment of the door are such that a force in excess of 50 pounds is needed to set the door in motion. For example, there may be a pressure differential between opposite sides of the door which increases the force needed to set the door in motion. Such pressure differentials can be intentional or can be transient events such as the result of operation of an internal HVAC system.

For safety reasons, the amount of force human operators need to apply to a door should never exceed 50 pounds of force and new doors may be limited by building codes to as little as 30 pounds of force. While foot or hand operated levers have been utilized to assist in door opening operations, such designs are frequently prohibited by safety codes because it requires two manual actions to operate the door. It remains a need in the art for a passive door assistance-opening device that compensates for a door weight or pressure and automatically operates upon initiation of a normal door opening sequence. Accordingly, there remains room for variation and improvement within the art.

SUMMARY OF THE INVENTION

It is one aspect of at least one of the present embodiments of the invention to provide a spring-assisted door opening mechanism that automatically engages and functions with a normal door opening sequence of steps.

It is an additional aspect of at least one of the present embodiments to provide a spring-assisted door mechanism which can be easily adjusted following installation to vary the amount of compensating force provided to a door opening sequence.

It is an additional aspect of at least one of the present embodiments to provide for a spring-assisted door opening mechanism which can be positioned such that the spring-assisted compensating force is applied to one of either a door frame or a door while mounted on the other.

It is one aspect of at least one present embodiment to provide for a spring-assisted door opening mechanism which is can provide an assistance force of between about 10 to about 50 pounds of force.

It is one aspect of at least one of the present embodiments to provide a spring-assisted door opening mechanism comprising:

a housing having a metal plate, the metal plate having at least one thru-bore;

a cylinder having a longitudinal axis, the longitudinal axis in alignment with the thru-bore;

a rod carried in the cylinder and the thru-bore, a first end of the rod extending from the thru-bore and defining an end cap having a diameter greater than a diameter of the rod, and a second end extending from a free end of the cylinder;

a coil spring carried by a shaft of the first end of the rod and retained on the rod between the end cap and a surface of a metal plate;

wherein, when the housing is secured to one either of a door frame or a door, the first end of the rod engages one either of a door frame or door, the spring providing a door entry assistance force to lessen the force needed by an operator to open a door.

It is a further aspect of at least one of the present embodiments of the present invention to a door opening assistance device comprising:

a housing defining at least one aperture there through;

a rod carried by the aperture having a first and a second threaded end;

a spring positioned along the length of the rod and secured along a circumference of the rod between a terminal end cap carried by the first rod threaded end and a surface of the housing;

a threaded nut carried by the second end of the rod and positionable along the length of the threaded end of the second rod, and;

wherein, when the housing is secured to one of either a door frame or a door, the end cap engages one of either a door frame or a door, the spring providing a compensating force to lessen the amount of force an operator needs to manually apply to set the door in motion.

It is a further aspect of at least one of the present embodiments to provide for a process of reducing the force needed to set the door in motion by providing a spring assistance force comprising:

supplying a door opening assist mechanism having a housing having a metal plate, metal plate having at least one thru-bore;

a cylinder having a longitudinal axis, the longitudinal axis in alignment with the chrubore;

a rod carried in the cylinder and the bore, a first end of the rod extending from the thru-bore and defining an end cap having a diameter greater than a diameter of the rod, and a second end extending from a free end of the cylinder;

a coil spring carried by a shaft of the first end of the rod and retained on the rod between the end cap and a surface of a metal plate;

maintaining the spring in a first compressed state when the door is in a closed position;

unlatching the door, the spring providing a compensating force that reduces the amount of force of a human operator needs to apply to set the door in motion.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Figure 1A:
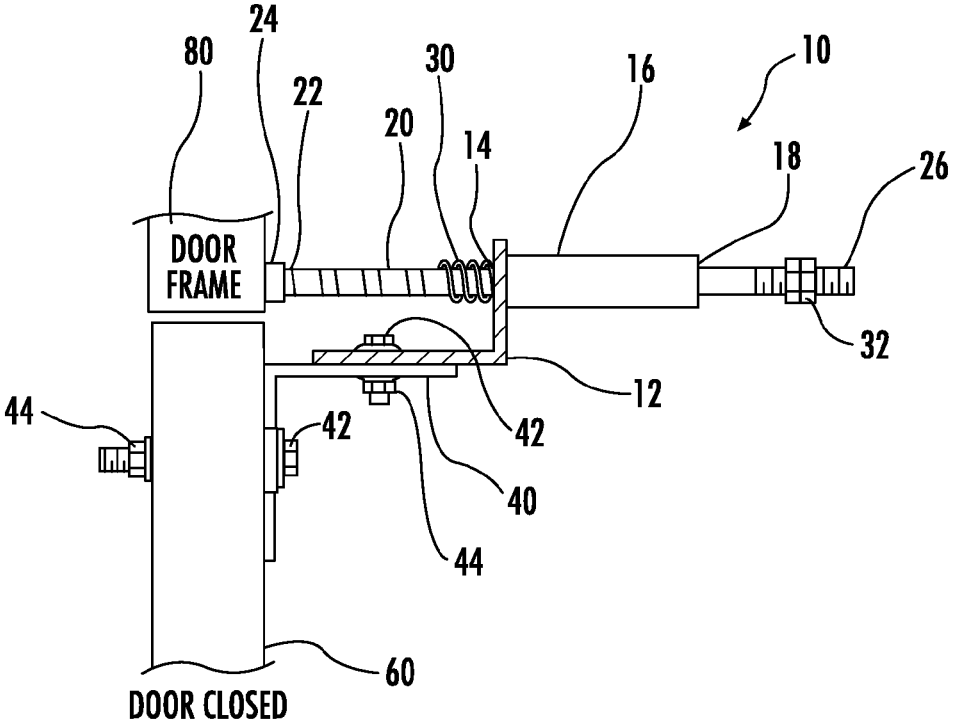
FIGS. 1*a* and 1*b* are side views of a door opening assist apparatus mounted to a door shown with a door closed (FIG. 1*a*) and with a door open (FIG. 1*b*).

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

In accordance to the present invention, it has been found that often a significant pressure differential exists across an egress door. A force required to set the door in motion can exceed what is permissible by the Life Safety Code (NFPA 101) and/or the local building code or fire code. To address that problem, the present invention sets forth various embodiments of a door opening spring assistance apparatus that will apply a door opening assistance with small rods and coil springs that attach either to the door or to the doorframe. The use of the rods and coil springs reduce the force required to set the door in motion and allows for easy field adjustment to adjust the tension levels.

The present invention is particularly useful in pressurized settings where pressure differentials provide for containment barriers for contamination control. There are a number of other industries and needs where a negative pressure is utilized to maintain a clean room environment.

The present invention is a completely passive device that requires no outside intervention once installed other than simply operating the latch mechanism and pushing or pulling to open the door. A device mounts near the top of the door to either the door or door frame in an obtrusive location and the spring-like design allows significant field adjustments to adapt to specific conditions and needs.

The bracket mounted spring assisters allow the supply of 16 to 47 pounds of force application depending whether 1, 2, or 3 spring configurations are utilized. By way of an example, a typical interlocking door prior to modification requires over 60 pounds of force to set the door in motion. The reduction of force by the door opening assist apparatus simplifies the door opening procedures by reducing the force required to operate the door and initially set it into motion.

Figure 1B:
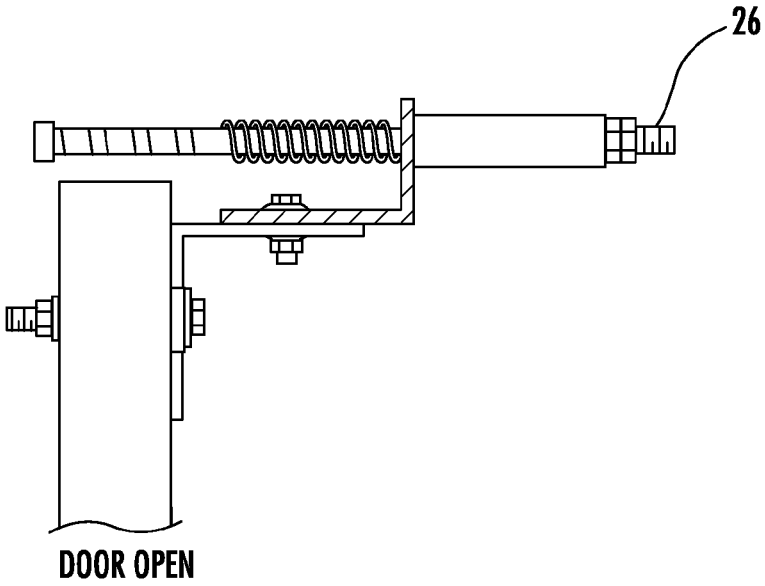

As best seen in reference to FIGS. 1*a* and 1*b*, a door assistance apparatus illustrated in which the apparatus 10 is set forth. While the opening assistance apparatus 10 is shown in operative engagement with a door frame 80, it is understood and appreciated by one of ordinary skill in the art that the attachment mechanism and mounting hardware as seen in reference to FIGS. 1*a* and 1*b* could be inverted 180° such that the spring operated rod is supported by a door frame 80 and engages a door 60. Such an arrangement is seen in further detail in reference to an additional embodiment of the invention set forth in FIG. 2.

In reference to FIGS. 1*a* and 1*b*, the door assistance apparatus 10 includes a support housing 12 seen in the form of an L-shaped bracket but could be in other shapes that serve the same purpose. The bracket defines an aperture of 14 through a vertical portion of the bracket. The aperture 14 is in axial alignment with a cylinder 16 defining a bore 18 there through. A rod 20 is asserted through the aligned bore 14 and the bore 18.

A first end 22 of rod 20 carries an end cap 24. End cap 24 may engage a threaded end of rod 22 of the otherwise secured to the end of rod 22 by a press fit or similar method of engagement. Preferably, the diameter of the end cap 24 is greater than a diameter rod 22 and which facilities the retention of a coil spring 30 between a surface of a housing and the end cap. As seen in reference to FIGS. 1*a* and 1*b*, coil spring 30 engages an exterior portion of rod 20.

A second end 26 of rod 20 extends beyond an opening of cylinder 16. A portion of rod end 26 may define a plurality of threads and is adapted for engaging a mated threaded nut 32. The position of threaded nut 32 can be varied along the mated thread of rod end 26, thereby controlling an effective link of rod 20, an effective link in relation to the extent rod 20 extends in a first direction relative to first rod end 22.

A horizontal arm of housing 12, seen in the form of the L-shaped bracket, engages a mounting member 40, mounting member 40 secured to the door. Alternatively, mounting member 40 could be secured to the door frame 80 and first rod end 22 engages against the door 60 instead. Mounting member 40 can be secured to housing 12 using conventional attachment members such as, threaded bolts 42 and locking nuts 44. Similar nut and bolt combinations 42 and 44 can be used to secure mounting member 40 to the door to the door as see in FIGS. 1*a* and 1*b* are used in embodiments to secure support housing 12 to a door frame. As seen in reference to FIG. 1*a*, when door 60 is in a closed position, spring 30 is placed in a compressed state between end cap 24 and a surface of support housing 12. When the door is unlatched by a normal operational step, the spring 30 exerts a force which directs rod 20 to extend its operative link as best seen in reference to FIG. 1*b*. The spring supplied force which is directed against the door frame lessens the amount of force the human operator needs to apply to open the door.

As noted above, the door assist apparatus can also be mounted to the door frame such that the compressive force of the rod and spring combination is directed against the door. By directing the force in an opening direction of the door, the amount of force a human operator needs to apply to the door is lessened.

As is known and conventional in the art, conventional pneumatic arm door closures and/or hinge springs can be used to provide a sufficient door closing force such that the door will automatically latch, thereby placing the rod and spring in a tensioned arrangement to provide assistance when the door is unlatched and the various adjustments allowed by the device allow for the force needed to close to be greater than the force applied by the device, therefore allowing the door to close and latch as expected.

Figure 2:
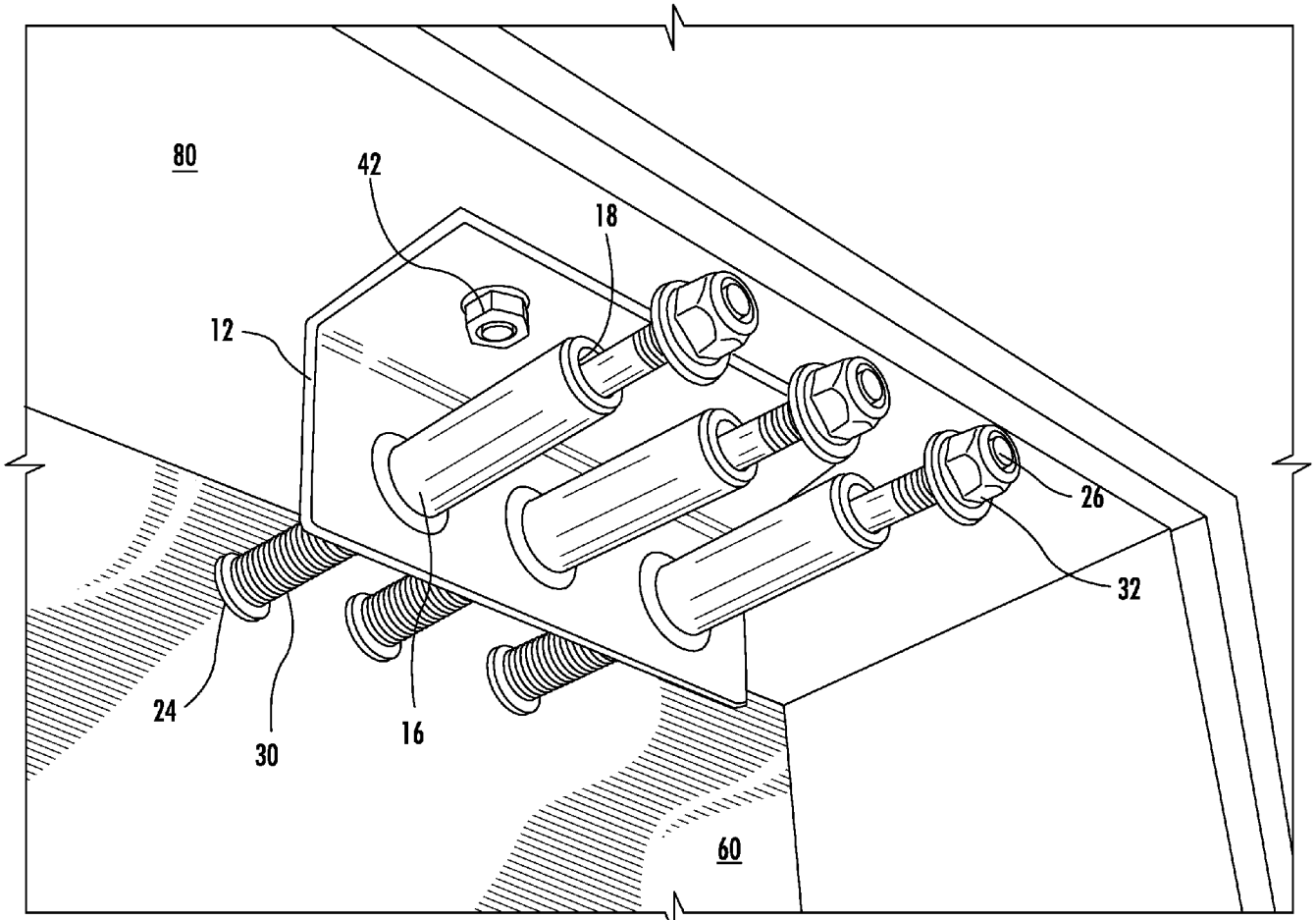
FIG. 2 is a perspective view of an embodiment of a door opening apparatus mounted to a door frame showing a plurality of spring tensioned rods which are used to provide a compensating force when opening a door.

As seen in reference to FIG. 2, an additional embodiment of the present invention seen in which the housing is secured to a door frame and the rod spring combination has a force which is directed against the associated door 60. The embodiment seen in FIG. 2 further provides for 3 similarly configured rods and tension springs which, in combination, can provide for a greater amount of door assistance compensating force. It has been found that with a three rod/spring embodiment up to about 50 pounds of a compensating force can be supplied.

As seen in reference to the Figures, various washers can be used as conventional within the art to help secure either the spring and/or position the nuts 32 relative to a second end 26 of rod 20. One embodiment of the housing as illustrated in reference to the FIGS. 1*a* & 1*b* can include an L-shaped bracket having associated cylinder bores aligned with the bracket apertures. Similar housings can be constructed of square shaped tubing or 3-sided tubing in which the cylinders extend either within the confines of the tubing or extend outwardly from the tubing. While the cylinders are not essential to the physical operation of the spring assisted opening apparatus 10, it is believed that the cylinders do prevent binding and excessive wear of the component parts. By preventing binding, the door assistance apparatus 10 has a smoother operation.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A spring-assisted door opening mechanism comprising;

a housing comprising a metal plate, the metal plate having at least one thru-bore;

a cylinder having a longitudinal axis and having a cylinder length substantially greater than a cylinder diameter, the longitudinal axis in alignment with the thru-bore;

a rod carried in the cylinder and the thru-bore, a first end of the rod extending from the thru-bore and supporting an end cap having a diameter greater than a diameter of the rod, and a second end extending from a free end of the cylinder;

a coil spring carried by the first end of the rod and retained on the rod between the end cap and a surface of the metal plate;

wherein, the end cap engages either a door frame or a door, the spring providing a door entry assistance force that is less than the amount of force needed to set the door in motion when the door is unlatched so as to lessen a force needed by an operator to open the door when the door is closed and has a greater first air pressure pressing against one side of the door than a second air pressure pressing against a second side of the door.

2. The door opening mechanism according to claim 1 wherein the rod is threaded at least along the first end and the second end.

3. The door opening mechanism according to claim 2 wherein the end cap is secured by threads to the first end of the rod.

4. The door opening mechanism according to claim 1 wherein a nut engages the second end of the rod.

5. The door opening mechanism according to claim 1 wherein the housing is carried by a support bracket, the support bracket is supported by either the door or the door frame.

6. A process of reducing the force needed to open a closed door comprising:

supplying a door opening assist mechanism having a housing comprising a metal plate, the metal plate having at least one thru-bore;

a cylinder having a longitudinal axis, the longitudinal axis in alignment with the thru-bore;

a rod carried in the cylinder and the thru-bore a first end of the rod extending from the thru-bore and defining an end cap having a diameter greater than a diameter of the rod, and a second end extending from a free end of the cylinder;

a coil spring carried by a shaft of the first end of the rod and retained on the rod between the end cap and a surface of a metal plate;

attaching the door opening assist mechanism so that the rod and end cap engages at least one of either a door or a door frame;

maintaining the spring in a compressed state when the door is in a closed position;

manually unlatching the door, and, wherein the coil spring provides a force that pushes the first rod end in a direction toward either the door or the door frame that is less than an amount of force needed to set the unlatched door in motion so as to lessen the force needed by an operator to set the door in motion.

7. The process according to claim 6 wherein the force provided by the coil spring is between 10 to about 50 pounds, thereby reducing the amount of force a human operator needs to apply to set the door in motion.

8. The process according to claim 6 wherein the door is closed and has a greater first air pressure pressing against a first side of the door than a second air pressure pressing against a second side of the door thereby creating a pressure differential that forms a portion of the force that is to be overcome to set the door in motion.

9. A door opening assistance device consisting essentially of:

a housing defining at least one aperture there through, the housing and aperture positioned to be opposite at least one of an upper edge of a door or an edge of a door frame;

a rod carried by the aperture having a first and a second threaded end;

a cylinder having a longitudinal axis and having a cylinder length substantially greater than a cylinder diameter the longitudinal axis in alignment with the aperture;

a spring positioned along the length of the rod and secured along a circumference of the rod between a terminal end cap carried by the first threaded end of the rod and a surface of the housing;

a threaded nut carried by the second end of the rod and positionable along a length of the second threaded end of the rod, and;

wherein, when the housing is secured to either the door frame or the door, the end cap engages the other of the door frame or the door, the spring providing a compensating force that is less than the amount of force needed to set the door in motion when the door is unlatched so as to lessen the amount of force an operator needs to manually apply to set the door in motion.

10. The door opening assistance device of claim 9 wherein when the end cap engages the door when it is closed, the housing is secured to the door frame.

11. The door opening assistance device of claim 9 wherein when the end cap engages the door frame, the housing is secured to the closed door.

* * * * *